US010919334B2

(12) United States Patent
Zhang et al.

(10) Patent No.: US 10,919,334 B2
(45) Date of Patent: Feb. 16, 2021

(54) ANTI-COUNTERFEITING PATTERN HAVING OPTICALLY VARIABLE STRUCTURE AND PREPARATION METHOD THEREOF

(71) Applicants: CHINA BANKNOTE INK CO., LTD., Shanghai (CN); CHINA BANKNOTE PRINTING AND MINTING CORPORATION, Beijing (CN)

(72) Inventors: Xing Zhang, Shanghai (CN); Qingfei Meng, Shanghai (CN); Yong Zhang, Shanghai (CN); Xiaoquan Zhou, Shanghai (CN); Guolin Yuan, Shanghai (CN); Shifan Zhang, Shanghai (CN)

(73) Assignees: CHINA BANKNOTE INK CO., LTD., Shanghai (CN); CHINA BANKNOTE PRINTING AND MINTING CORPORATION, Beijing (CN)

( * ) Notice: Subject to any disclaimer, the term of this patent is extended or adjusted under 35 U.S.C. 154(b) by 0 days.

(21) Appl. No.: 16/236,479

(22) Filed: Dec. 29, 2018

(65) Prior Publication Data

US 2019/0135018 A1 May 9, 2019

Related U.S. Application Data

(63) Continuation-in-part of application No. 15/033,106, filed as application No. PCT/CN2014/090044 on Oct. 31, 2014, now abandoned.

(30) Foreign Application Priority Data

Nov. 1, 2013 (CN) ..... 2013 1 0534864

(51) Int. Cl.
*B42D 25/324* (2014.01)
*B42D 25/337* (2014.01)
(Continued)

(52) U.S. Cl.
CPC ..... *B42D 25/324* (2014.10); *B41M 3/008* (2013.01); *B41M 3/148* (2013.01); *B42D 25/337* (2014.10);
(Continued)

(58) Field of Classification Search
CPC .. B42D 25/324; B42D 25/425; B42D 25/337; B42D 2033/24
See application file for complete search history.

(56) References Cited

U.S. PATENT DOCUMENTS 4,124,947 A * 11/1978 Kuhl ..... B42D 25/29 101/150
2007/0273146 A1* 11/2007 Davis ..... B42D 25/29 283/91

* cited by examiner

*Primary Examiner* — Kyle R Grabowski
(74) *Attorney, Agent, or Firm* — Global IP Services; Tianhua Gu

(57) ABSTRACT

An anti-counterfeiting pattern having an optically variable structure, comprising lithographic lines and gravure blind embossed relief lines printed on a carrier. The lithographic lines are a set of lithographic curve lines having a curvature, the widths of the lithographic curve lines changing from thick to thin, or thin to thick. The gravure blind embossed relief lines are a set of curve lines corresponding to the lithographic lines, and having the same curvature. The relief lines are overprinted on the lithographic lines with a width variation identical to that of said lithographic lines. Accurate overprinting of the two printing types forms a curved relief structure wherein the width of the lines changes continuously. When a printed product is rotated and observed, a continuously variable optical effect will be seen, which is visual, readily to identify, anti-copying and difficult to forgery.

7 Claims, 2 Drawing Sheets

(51) Int. Cl.

| | |
|---|---|
| ***B42D 25/425*** | (2014.01) |
| ***B41M 3/00*** | (2006.01) |
| ***D21H 21/48*** | (2006.01) |
| ***B41M 3/14*** | (2006.01) |
| ***D21H 21/40*** | (2006.01) |
| *B42D 25/29* | (2014.01) |
| *B41M 1/10* | (2006.01) |
| *B41M 1/06* | (2006.01) |

(52) U.S. Cl.

CPC ..... *B42D 25/425* (2014.10); *D21H 21/40* (2013.01); *D21H 21/48* (2013.01); *B41M 1/06* (2013.01); *B41M 1/10* (2013.01); *B42D 25/29* (2014.10)

ANTI-COUNTERFEITING PATTERN HAVING OPTICALLY VARIABLE STRUCTURE AND PREPARATION METHOD THEREOF

CROSS REFERENCE TO RELATED PATENT APPLICATION

The present application is a continuation in part application of the U.S. Ser. No. 15/033,106 filed on Apr. 28, 2016, the U.S. Ser. No. 15/033,106 is the US national stage of PCT/CN2014/090044 filed on Oct. 31, 2014, which claims the priority of the Chinese patent applications No. 2013 1053 4864.7 filed on Nov. 1, 2013, the applications mentioned above are incorporated herein by reference.

FIELD OF INVENTION

The present invention relates to an anti-counterfeiting pattern and a preparation method thereof, and particularly relates to a dynamic optically variable anti-counterfeiting pattern and a preparation method thereof.

DESCRIPTION OF RELATED ARTS

The engraving gravure invisible pattern technology has been widely used in the banknote printing industry, and has become a popular readily identifiable anti-counterfeiting technology. Generally, the line number of the pattern of invisible part is identical to that of the pattern of visible part, with a texture comparison arrangement of 45-90 degree. However, more generally, the engraving gravure is overprinted with an offset printing accurate design, wherein the engraving gravure is inkless blind embossing. Therefore, when rotationally observing, a gray level or optically variable effect is generated due to the angle changes between a highlight line of the pattern and the shadow thereof, but no dynamic effect. A Chinese invention patent, with an application No. 200610020757.2, provides an invisible anti-counterfeiting pattern capable of generating dynamically variable engraving gravure, however, the pattern consists of parallel lines, and is not accurate overprinted with other graphic pattern (e.g., offset print).

A Chinese patent CN1262430 provides a data carrier having an optically variable structure, wherein the structure is combined by an engraving gravure relief structure and an overprinted print form, such that a part of the print form is visible when vertically viewing, but is invisible when obliquely viewing. Thereby, when alternately viewing vertically and obliquely, an oblique effect is generated, but no dynamic optically color changing effect is generated during the rotation.

In the known optically variable anti-counterfeiting print design, basically the offset line printing is disposed on the blind embossed side part, with the result of obvious comparison or oblique effect, but narrow optically color changing visual angle. Thus it requires for finding out an accurate observation angle, which is not suitable for quick observation. Besides, the optically variable effect is discontinuous and has no dynamic change.

SUMMARY OF THE PRESENT INVENTION

An object of the present invention is to disclose an anti-counterfeiting pattern having an optically variable structure and a preparation method thereof, to solve the disadvantages in the prior art.

The anti-counterfeiting pattern having the optically variable structure of the present invention comprises lithographic lines and gravure blind embossed relief lines printed on a carrier.

The lithographic lines are a set of lithographic curve lines having a curvature, the widths of the lithographic curve lines changes from thick to thin, or thin to thick, i.e., gradually and continuously changes from 200-500 μm to 20-50 μm, or gradually and continuously changes from 20-50 μm to 200-500 μm, while curvatures of the lithographic curve lines continuously changes from 0.01-0.02 $mm^{-1}$ to 1-2 $mm^{-1}$.

The gravure blind embossed relief lines are a set of curve lines corresponding to the lithographic lines, and having the same curvature. The relief lines are overprinted on the lithographic lines with a width variation identical to that of said lithographic lines, and the width at the same point is slightly 2-5 μm larger than that of the lithographic lines. The carrier is a paper or a thin film.

The engraving gravure blind embossed relief lines are combined with the lithographic lines, such that a continuously variable optical effect is generated when the whole area is rotated along with view angles. Therefore, when a printed product is rotated, a pattern of a continuously variable optical effect will be seen.

The preparation method of the anti-counterfeiting pattern having an optically variable structure, comprises the following steps of: firstly performing a lithography, which may be an offset printing or a pad printing; then adopting engraving gravure with a inkless or transparent printing ink and accurately overprinting on lithographic lines, to obtain the anti-counterfeiting pattern having an optically variable structure.

Preferably, in the above steps, a layer of interferential lithographic pattern may be added on the curve lithographic lines as needed.

As compared to the prior art, the present invention has the prominent technical effects that: accurate overprinting of the two printing types forms a curved relief structure wherein the width of the lines changes continuously. When a printed product is rotated and observed, a continuously variable optical effect will be seen, which is visual, readily to identify, anti-copying and difficult to forgery. The dynamic optically variable anti-counterfeiting pattern and the preparation method thereof can be applied in the anti-counterfeiting of securities.

DETAILED DESCRIPTION OF THE PREFERRED EMBODIMENTS

Figure 1:
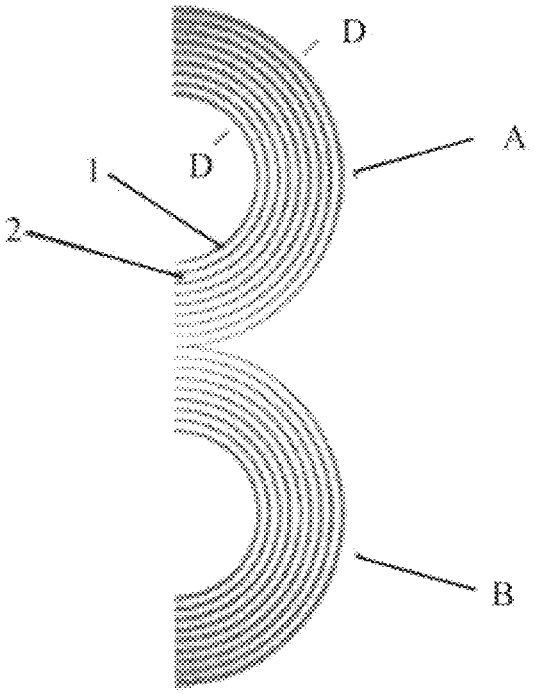
FIG. 1 shows a structural diagram of an anti-counterfeiting pattern having the optically variable structure.

Please refer to FIG. 1, the anti-counterfeiting pattern having the optically variable structure of the present invention comprises lithographic lines 1 and gravure blind embossed relief lines 2 printed on a carrier.

The lithographic lines 1 are a set of lithographic curve lines having a curvature, the width m of the lithographic curve line changes from thick to thin, or thin to thick, i.e., gradually and continuously changes from 200-500 μm to 20-50 μm, or gradually and continuously changes from 20-50 μm to 200-500 μm, while curvature of the lithographic curve line continuously changes from 0.01-0.02 $mm^{-1}$ to 1-2 $mm^{-1}$.

The gravure blind embossed relief lines 2 are a set of curve lines corresponding to the lithographic lines, and having the same curvature.

The relief lines 2 are overprinted on the lithographic lines 1 with a width variation identical to that of said lithographic lines 1, and the width at the same point is slightly 2-5 μm larger than that of the lithographic lines.

The accuracy error of the overprinting between the engraving gravure blind embossed relief lines 2 and the lithographic lines 1 is no more than 10 μm.

Preferably, the width of the engraving gravure blind embossed relief lines 2 is slightly 3-4 μm larger than that of the lithographic lines 1. The ratio between the width of the engraving gravure blind embossed relief lines 2 and the interval of the engraving gravure blind embossed relief lines 2 continuously changes from 10:1 to 1:10, or continuously changes from 1:10 to 10:1.

Embodiment 1

Figure 2:
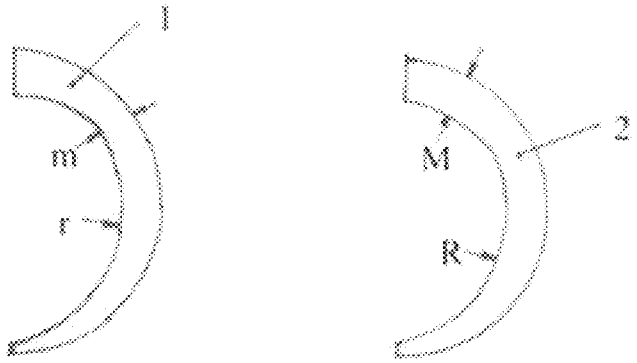
FIG. 2 is an enlarged view showing a lithographic line and a relief line of the anti-counterfeiting pattern.
Figure 3:
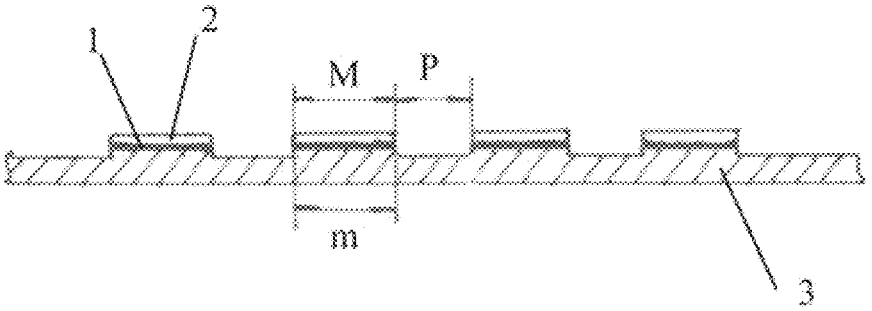
FIG. 3 is an enlarged cross section view along the D-D direction in the FIG. 1.

Please refer to FIGS. 1 to 3.

As shown in figures, in the upper part (i.e., part A in FIG. 1):

It firstly adopts ordinary black ink to perform a lithography 1 on a paper 3 by offset printing, wherein the whole graphic pattern is concentric circles, and the widths m of the lithographic lines 1 continuously changes from 200 μm to 20 μm, that is, from thick to thin. Then, the relief lines 2 are overprinted by using inkless air compressor technology, the lines 2 are accurately overprinted on the lines 1, and the widths M of the relief lines 2 continuously changes from 210 μm to 25 μm, that is, from thick to thin.

In the lower part (i.e., part B in FIG. 1): The widths m of the lithographic lines 1 continuously changes from 20 μm to 200 μm, that is, from thin to thick, and an ordinary black ink print is adopted herein.

Then, the relief lines 2 are overprinted by using inkless air compressor technology, the lines are accurately overprinted on the lines 1, and the widths M of the relief lines 2 continuously changes from 25 μm to 210 μm.

Preferably, the width M of the engraving gravure blind embossed relief lines 2 is slightly 3-4 μm larger than that m of the lithographic lines 1. The ratio between the width M of the engraving gravure blind embossed relief lines 2 and the interval P of the engraving gravure blind embossed relief lines 2 continuously changes from 10:1 to 1:10, or continuously changes from 1:10 to 10:1.

Embodiment 2

A preparation method of the anti-counterfeiting pattern having an optically variable structure, comprises the following steps:

performing a lithography, wherein the lithographic lines are a set of lithographic curve lines 1, the widths m of the lithographic curve lines changes from thick to thin, or thin to thick;

adopting gravure with a inkless or transparent printing ink, wherein the gravure blind embossed relief lines 2 are a set of curve lines corresponding to the lithographic lines 1; the relief lines 2 are overprinted on the lithographic lines 1, the widths M of the gravure blind embossed relief lines 2 changes from thick to thin, or thin to thick;

wherein the widths m of the lithographic curve lines 1 gradually and continuously changes from 200-500 μm to 20-50 μm, or gradually and continuously changes from 20-50 μm to 200-500 μm;

wherein curvatures r of the lithographic curve lines 1 continuously changes from 0.01-0.02 $mm^{-1}$ to 1-2 $mm^{-1}$;

wherein widths M of the relief lines is slightly 2-5 μm larger than that of the lithographic lines 1 at the same point.

wherein the lithography is an offset printing or a pad printing.

wherein the accuracy error of the overprinting between the gravure blind embossed relief lines and the lithographic lines is no more than 10 μm.

In such way, the anti-counterfeiting pattern having an optically variable structure is obtained. The obtained graphic pattern may generate a continuously variable optical effect along with the rotation of the printed product.

What is claimed is:

1. An anti-counterfeiting pattern having the optically variable structure, comprising lithographic lines and gravure blind embossed relief lines printed on a carrier;

the lithographic lines are a set of lithographic curve lines, the widths of each of the lithographic curve lines changes from thick to thin or thin to thick from one end to other end;

the gravure blind embossed relief lines are a set of curve lines corresponding to the lithographic lines; the relief lines are superimposed on the lithographic lines, the widths of the gravure blind embossed relief lines changes from thick to thin or thin to thick from one end to other end;

the widths of each of the lithographic curve lines are gradually decreased from 200-500 μm to 20-50 μm from one end to other end, or gradually increased from 20-50 μm to 200-500 μm from one end to other end;

curvatures of the lithographic curve lines are incrementally changed from 0.01-0.02 $mm^{-1}$ to 1-2 $mm^{-1}$ from one end to other end;

widths of the relief lines are slightly 2-5 μm larger than that of the lithographic lines at the same point.

2. The anti-counterfeiting pattern having the optically variable structure according to claim 1, characterized in that, the width of the gravure blind embossed relief lines is 3-4 μm larger that of the lithographic lines.

3. The anti-counterfeiting pattern having the optically variable structure according to claim 2, characterized in that, the ratio between the width of the gravure blind embossed relief lines and an interval of the gravure blind embossed relief lines is continuously decreased from 10:1 to 1:10, or continuously increased from 1:10 to 10:1.

4. The anti-counterfeiting pattern having the optically variable structure according to claim 1, characterized in that, the ratio between the width of the gravure blind embossed relief lines and an interval of the gravure blind embossed relief lines is continuously decreased from 10:1 to 1:10, or continuously increased from 1:10 to 10:1.

5. A preparation method of the anti-counterfeiting pattern having an optically variable structure, comprises the following steps:

performing a lithography, wherein the lithographic lines are a set of lithographic curve lines, the widths of the lithographic curve lines changes from thick to thin or thin to thick from one end to other end;

adopting gravure with a inkless or transparent printing ink, wherein the gravure blind embossed relief lines are a set of curve lines, corresponding to the lithographic lines; the relief lines are superimposed on the lithographic lines, the width of each of the gravure blind embossed relief lines is changed from thick to thin or thin to thick from one end to other end;

wherein the widths of the lithographic curve lines are gradually decreased from 200-500 82 m to 20-50 μm, or gradually increased from 20-50 μm to 200-500 μm;

wherein curvatures of the lithographic curve lines are incrementally changed from 0.01-0.02 $mm^{-1}$ to 1-2$mm^{-1}$ from one end to other end;

wherein widths of the relief lines is slightly 2-5 μm larger than that of the lithographic lines at the same point.

6. The preparation method of the anti-counterfeiting pattern having an optically variable structure according to claim 5, wherein the lithography is an offset printing or a pad printing.

7. The preparation method of the anti-counterfeiting pattern having an optically variable structure according to claim 5, wherein the accuracy error of the overprinting between the gravure blind embossed relief lines and the lithographic lines is no more than 10 μm.

* * * * *